US008903282B2

(12) United States Patent
Suzuki et al.

(10) Patent No.: US 8,903,282 B2
(45) Date of Patent: Dec. 2, 2014

(54) IMAGE FORMING APPARATUS WITH TRANSLATION CAM

(75) Inventors: Yasuhiro Suzuki, Nagoya (JP); Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 344 days.

(21) Appl. No.: 13/432,073

(22) Filed: Mar. 28, 2012

(65) Prior Publication Data

US 2012/0251179 A1 Oct. 4, 2012

(30) Foreign Application Priority Data

Mar. 31, 2011 (JP) ..... 2011-078457

(51) Int. Cl.
*G03G 15/08* (2006.01)
*G03G 15/01* (2006.01)

(52) U.S. Cl.
CPC ..... *G03G 15/0121* (2013.01); *G03G 15/0126* (2013.01); *G03G 15/0813* (2013.01)
USPC ..... 399/228

(58) Field of Classification Search
USPC ..... 399/110, 119, 223, 228
See application file for complete search history.

(56) References Cited

U.S. PATENT DOCUMENTS 7,555,245 B2 * 6/2009 Kamimura ..... 399/228
7,885,562 B2 * 2/2011 Wang et al. ..... 399/228
7,920,807 B2 * 4/2011 Tomatsu ..... 399/119
2003/0138275 A1 7/2003 Yabuki et al.
2005/0269922 A1 12/2005 Lai
2007/0177899 A1 8/2007 Kawamura
2009/0190958 A1 7/2009 Wang et al.
2009/0252530 A1 10/2009 Nakashima

FOREIGN PATENT DOCUMENTS

JP 2009-036919 A 2/2009
JP 2009-162903 7/2009
JP 2010-262062 11/2010

OTHER PUBLICATIONS

Extended European Search Report issued in corresponding European Patent Application No. 12161214.7 mailed Aug. 6, 2013.
Co-pending U.S. Appl. No. 13/432,043, filed Mar. 28, 2012.
Co-pending U.S. Appl. No. 13/432,061, filed Mar. 28, 2012.
May 6, 2014 Office Action issued in Chinese Patent Application No. 201210090346.6.

* cited by examiner

*Primary Examiner* — William J Royer
(74) *Attorney, Agent, or Firm* — Banner & Witcoff, Ltd.

(57) ABSTRACT

An image forming apparatus includes a translation cam having a cam surface configured to move a developing roller from a contact position contacting a photosensitive member to a retracted position retracted from the photosensitive member and further having a holding surface configured to hold the developing roller at the retracted position. The image forming apparatus further includes a first engaging portion. The translation cam includes a second engaging portion. The first engaging portion and the second engaging portion are configured to engage each other before a functioning surface of the translation cam is switched from the holding surface to the cam surface.

11 Claims, 18 Drawing Sheets

FRONT ⟷ REAR

IMAGE FORMING APPARATUS WITH TRANSLATION CAM

CROSS REFERENCE TO RELATED APPLICATION

This application claims priority from Japanese Patent Application No. 2011-078457, which was filed on Mar. 31, 2011, the entire subject matter of which is incorporated herein by reference.

BACKGROUND

1. Technical Field

The present invention relates to an image forming apparatus provided with a translation cam configured to cause a developing roller to come into contact with and to be retracted from a photosensitive drum.

2. Related Art

An image forming apparatus including a plurality of photosensitive drums, a plurality of developing rollers provided corresponding to the respective photosensitive drums, a translation cam configured to be movable in a linear direction so as to cause the respective developing rollers to come into contact with and to be retracted from the respective photosensitive drums, and a stepping motor configured to drive the translation cam is known. In this technology, since the translation cam can be stopped at a desired position by the stepping motor, the translation cam can be located reliably at respective positions for a color mode (a mode in which all the developing rollers are brought into contact with the photosensitive drums) or a monochrome mode (a mode in which only a developing roller for monochrome is brought into contact with the photosensitive drums), whereby operations in the respective modes can be performed satisfactorily.

In the technology described above, since the stepping motor specific for driving the translation cam is provided, there is a problem of cost increase. In contrast, driving of the translation cam using a different motor in the image forming apparatus (for example, a motor configured to drive the photosensitive drum) is contemplated.

However, in this case, if the motor is a motor having a weak holding power such as a DC motor, when the motor being driven is stopped, the motor rotates by its inertia. Consequently, the translation cam may pass over the desired position.

SUMMARY

A need has arisen to provide an image forming apparatus in which a translation cam can be stopped at a desired position even with a motor having a weak holding power such as a DC motor.

Aspects of the invention provide an image forming apparatus which includes a translation cam. The translation cam has a cam surface configured to move a developing roller from a contact position contacting a photosensitive member to a retracted position retracted from the photosensitive member and further has a holding surface configured to hold the developing roller at the retracted position. The image forming apparatus further includes a first engaging portion. The translation cam includes a second engaging portion. The first engaging portion and the second engaging portion are configured to engage each other before a functioning surface of the translation cam is switched from the holding surface to the cam surface.

BRIEF DESCRIPTION OF THE DRAWINGS

For a more complete understanding of the present invention, the needs satisfied thereby, and the features and advantages thereof, reference now is made to the following descriptions taken in connection with the accompanying drawings wherein.

DESCRIPTION OF PREFERRED EMBODIMENTS

Figure 1:
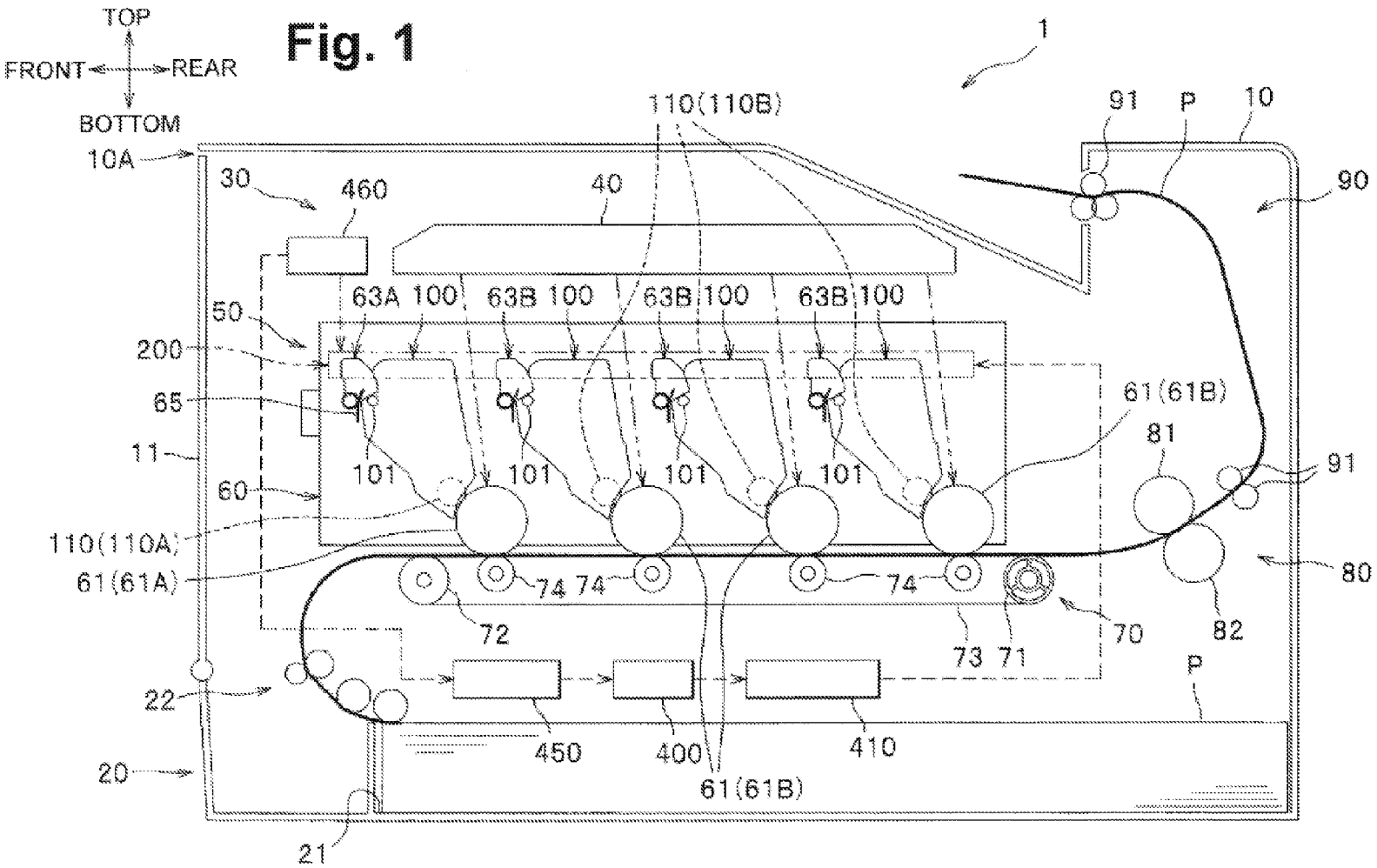
FIG. 1 is a drawing schematically showing a color printer according to an embodiment of the invention.
Figure 2:
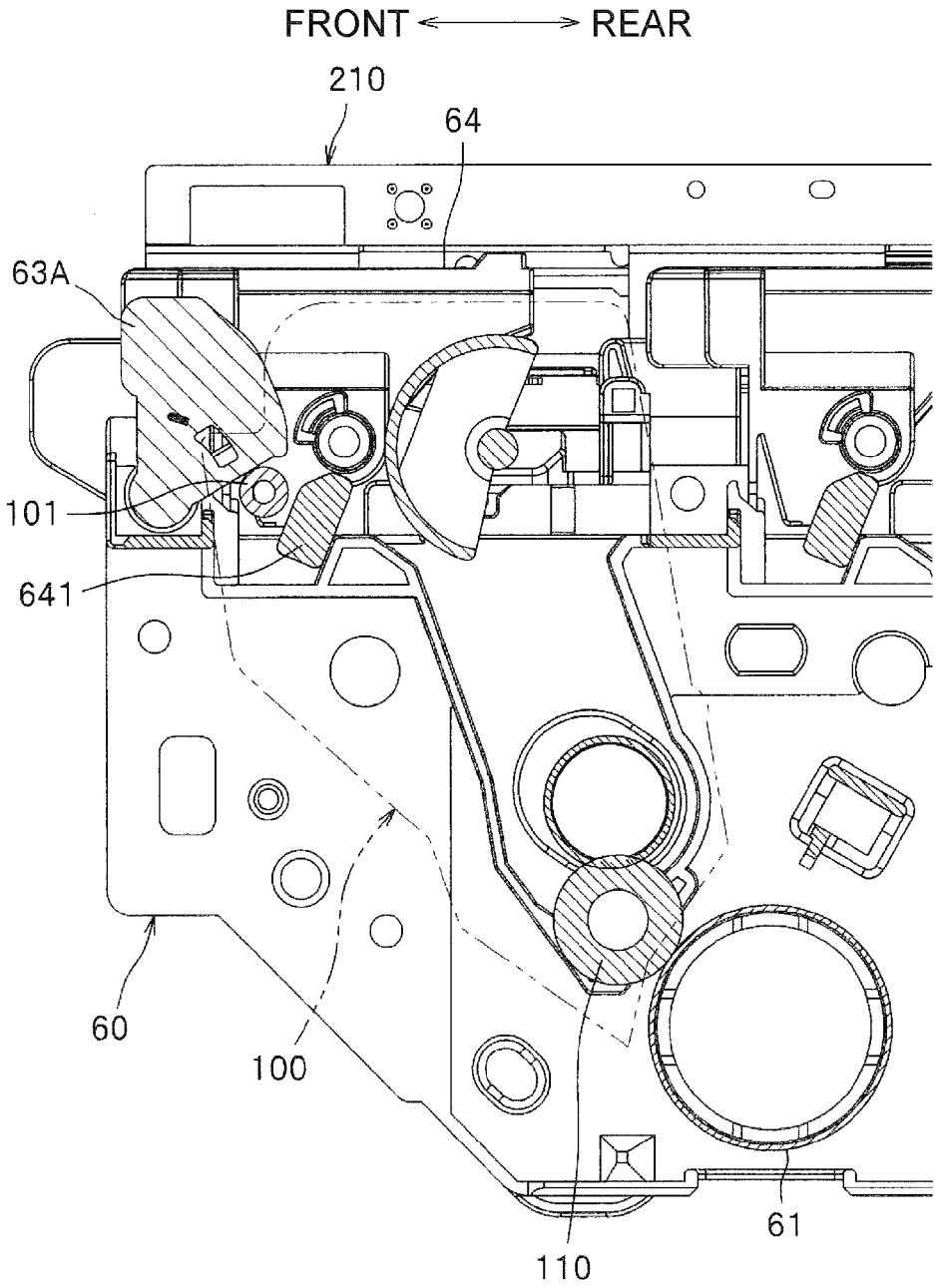
FIG. 2 is a cross-sectional view showing a state in which a developing roller is located at a contact position.

Embodiments of the invention and their features and advantages may be understood by referring to FIGS. 1-18B, like numerals being used for like corresponding parts in the various drawings. Hereinafter, an embodiment of the invention will be described by appropriately referring to the drawings. Further, the embodiment to be described below is merely an example of the invention, and may be, of course, appropriately modified within the scope in which the concept of the invention is not changed. In the description given below, an entire configuration of a color printer as an example of an image forming apparatus will be described first, and then characteristic portions of the invention will be described in detail.

In the following description, the directions are expressed with reference to a user using a color printer. In other words, in FIG. 1, the observer's left side is expressed as "front side", the observer's right side is expressed as "rear side", the side far from the observer is expressed as "left side", and the near side to the observer is expressed as "right side". The vertical direction for the observer is expressed as "vertical direction".

As shown in FIG. 1, a color printer 1 includes a paper feed unit 20 configured to feed paper P, an image forming unit 30 configured to form an image on the supplied paper P, and a paper discharge unit 90 configured to discharge the paper P having the image formed thereon in the interior of an apparatus body 10.

The paper feed unit 20 includes a paper feed tray 21 configured to accommodate the papers P and a paper transporting apparatus 22 configured to transport the paper P from the paper feed tray 21 to the image forming unit 30.

The image forming unit 30 includes a scanner unit 40, a process unit 50, a transfer unit 70, and a fixing device 80.

The scanner unit 40 is provided on an upper portion in the apparatus body 10 and includes a laser beam emitting unit, a polygon mirror, a lens, and a reflection mirror, not illustrated. Then, in the scanner unit 40, surfaces of respective photosensitive drums 61 (photosensitive member) of the process unit 50 are irradiated with laser beams passing through routes indicted by double-dashed chain lines in the drawing by a high-speed scanning.

The process unit 50 is configured to be mountable to and demountable from the apparatus body 10 through an opening 10A formed by opening a front cover 11 arranged on a front surface of the apparatus body 10. The process unit 50 includes a drawer 60, and four developing cartridges 100 provided so as to be mountable to and demountable from the drawer 60.

The drawer 60 is provided with known chargers, not illustrated, in addition to the four respective photosensitive drums 61.

The developing cartridge 100 is provided with a developing roller 110 configured to supply toner as an example of developer to the respective photosensitive drums 61 by coming into contact thereto so as to be rotatable, a known toner storage chamber, and a supply roller as needed.

The transfer unit 70 is provided between the paper feed unit 20 and the process unit 50, and includes a drive roller 71, a driven roller 72, a transporting belt 73, and four transfer rollers 74.

The drive roller 71 and the driven roller 72 are arranged in parallel so as to be apart from each other in the fore-and-aft direction, and the transporting belt 73 formed of an endless belt is tightly extended therebetween. An outside surface of the transporting belt 73 is in contact with the respective photosensitive drums 61. Arranged inside the transporting belt 73 are the four transfer rollers 74 configured to nip the transporting belt 73 in cooperation with the respective photosensitive drums 61 so as to oppose the respective photosensitive drums 61. The transfer rollers 74 each are subjected to application of a transfer bias by constant current control at the time of transfer.

The fixing device 80 is arranged on the back side of the process unit 50 and the transfer unit 70, and includes a heat roller 81 and a press roller 82 arranged so as to oppose the heat roller 81 and press the heat roller 81.

In the image forming unit 30 configured in this manner, the surfaces of the respective photosensitive drums 61 are charged uniformly by the chargers first, and then are exposed by the scanner unit 40. Accordingly, potentials of the exposed portions are lowered, and electrostatic latent images on the basis of image data are formed on the respective photosensitive drums 61. Then, the toner in the developing cartridges 100 is supplied to electrostatic latent images on the respective photosensitive drums 61 by the developing rollers 110, so that the toner images are carried on the photosensitive drums 61.

Subsequently, by passage of the paper P supplied onto the transporting belt 73 between the respective photosensitive drums 61 and the respective transfer rollers 74, the toner images formed on the respective photosensitive drums 61 are transferred onto the paper P. Then, by the passage of the paper P between the heat roller 81 and the press roller 82, the toner image transferred onto the paper P is fixed by heat.

The paper discharge unit 90 mainly includes a plurality of transporting rollers 91 configured to transport the paper P. The paper P having the toner images transferred and heat-fixed thereto is transported by the transporting rollers 91, and is discharged out from the apparatus body 10.

<Structure of Contact and Retract Cam 200>

Subsequently, the structure of a contact and retract cam 200 will be described in detail.

The contact and retract cam 200 is a translation cam which is movable in the fore-and-aft direction (the direction of arrangement of a plurality of the developing rollers 110), and is coupled to a DC motor 400 as an example of a drive source which is rotatable in the normal and reverse direction provided on the apparatus body 10 via an electromagnetic clutch 410. In other words, a transmitting mechanism which transmits a drive force from the DC motor 400 to the contact and retract cam 200 is provided with the electromagnetic clutch 410. Accordingly, the DC motor 400 can be used for other applications (for example, for driving the photosensitive drums 61).

Then, the contact and retract cam 200 is configured to move the developing rollers 110 between contact positions (positions illustrated in FIG. 2) where the developing rollers 110 come into contact with the photosensitive drums 61 and retracted positions (positions illustrated in FIG. 3) where the developing rollers 110 are retracted from the photosensitive drums 61 by moving in the fore-and-aft direction upon receipt of a drive force from the DC motor 400 (for example, a drive force in a case where a control device 450 turns the drive of the DC motor 400 ON). More specifically, the contact and retract cam 200 moves a first developing roller 110A for monochrome from among the plurality of the developing rollers 110 between a first contact position where the first developing roller 110A comes into contact with a first photosensitive drum 61A for monochrome and a first retracted position where the first developing roller 110A is retracted from the first photosensitive drum 61A, and moves three second developing rollers 110B for colors between second contact positions where the second developing rollers 110B come into contact with respective second photosensitive drums 61B for colors and second retracted positions where the second developing rollers 110B are retracted from the respective second photosensitive drums 61B.

More specifically, the respective developing rollers 110 are configured to be urged toward the photosensitive drums 61 via the developing cartridges 100 by a first pressing member 63A as an example of a first urging member and second pressing members 63B as an example of a second urging member. Here, the first pressing member 63A is a member configured to urge the first developing roller 110A for monochrome. The second pressing members 63B are members configured to urge the second developing rollers 110B for colors, and three of the second pressing members 63B are provided corresponding to the three second developing rollers 110B.

Then, the respective pressing members 63A and 63B are provided in the drawer 60 so as to be rotatable, and urge projections 101 formed on the developing cartridges 100 toward the photosensitive drums 61 by being urged clockwise in the drawing by torsion springs 65.

Figure 3:
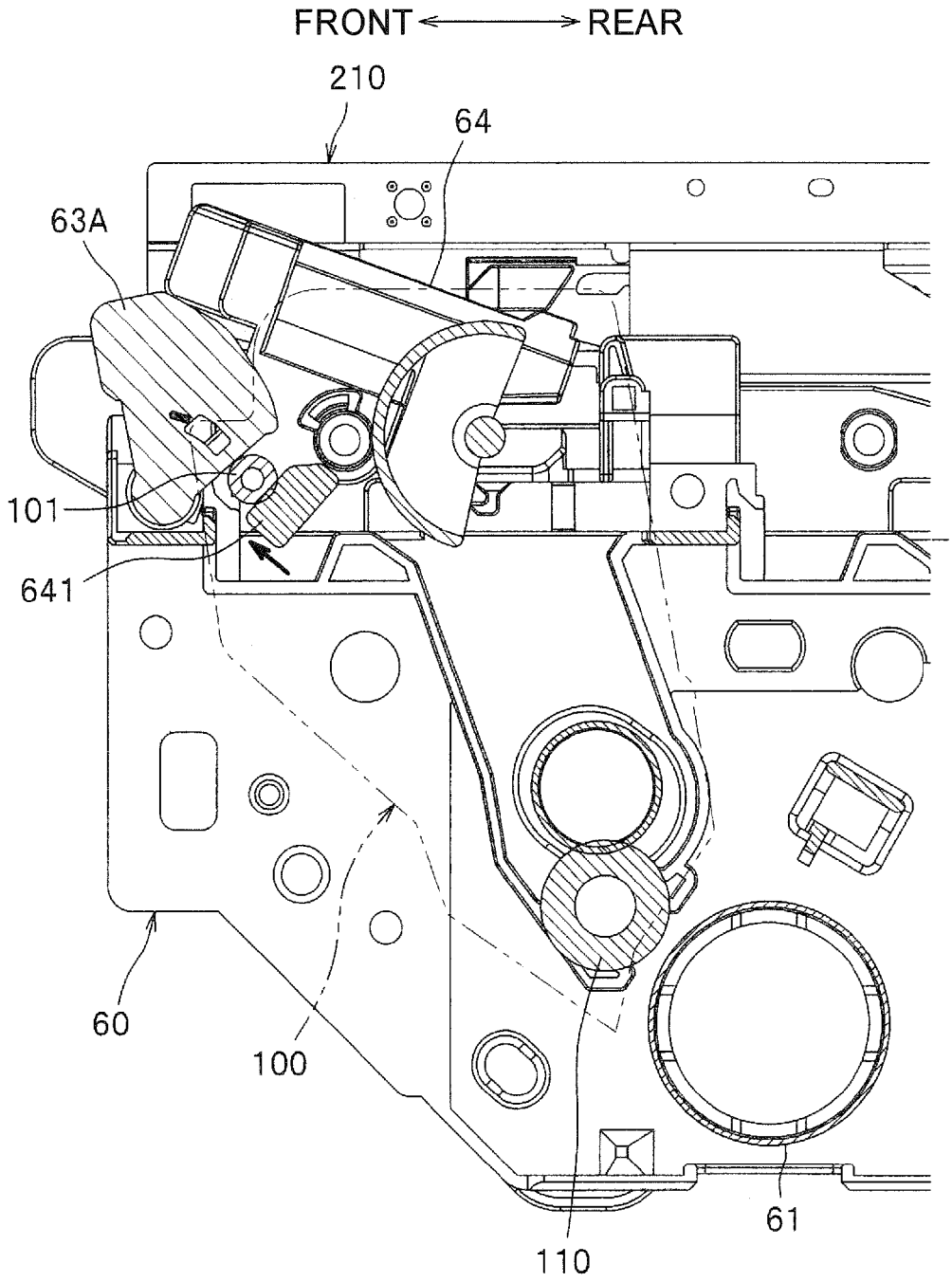
FIG. 3 is a cross-sectional view showing a state in which the developing roller is located at a retracted position.
Figure 4:
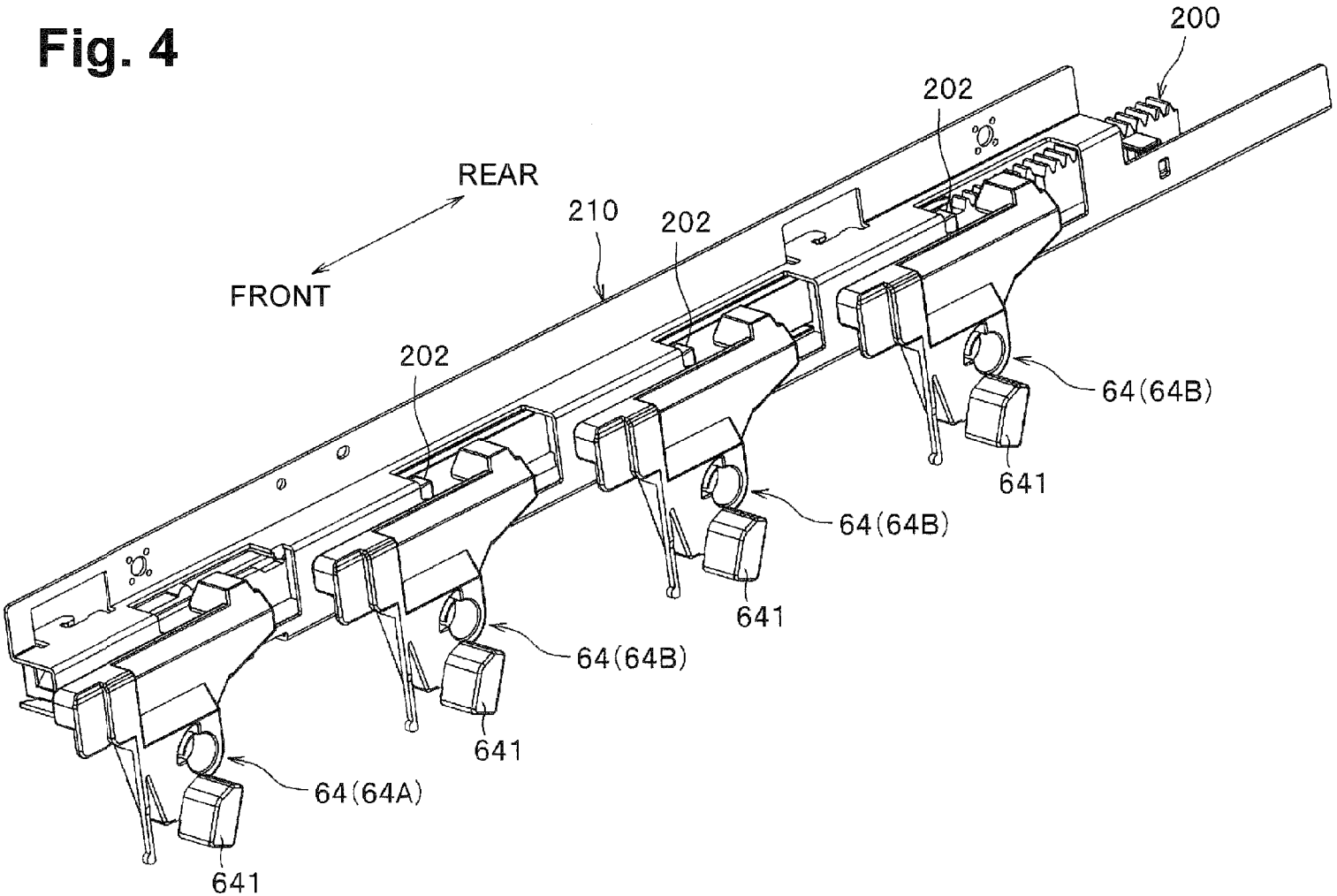
FIG. 4 is a perspective view of a contact and retract cam viewed from inside in the lateral direction.

As shown in FIGS. 1-4, in the drawer 60, a plurality of retraction levers 64 configured to press the projections 101 of the developing cartridges 100 against the urging forces of the pressing members 63A (63B) are provided corresponding to the respective developing cartridges 100 so as to move the developing rollers 110 away from the photosensitive drums 61. Accordingly, as shown in FIG. 3, when each of the retraction levers 64 is rotated clockwise in the drawing, the projection 101 is pushed obliquely upward by a pressing portion 641 of the retraction lever 64 and the developing roller 110 is retracted from the photosensitive drum 61. Then, the respective refraction levers 64 are configured to be activated respectively by the contact and retract cam 200 shown in FIGS. 4 and 5.

More specifically, the contact and retract cam 200 is movable supported in the fore-and-aft direction (a predetermined direction) by a supporting member 210 as an example of an adjacent member fixed to the apparatus body 10 so as to be adjacent to the contact and retract cam 200, and mainly includes a first cam surface 201 and three second cam surfaces 202.

The first cam surface 201 is a cam surface configured to move the first developing roller 110A for monochrome from the first contact position to the first retracted position, and is formed obliquely with respect to the fore-and-aft direction. Formed on the front side of the first cam surface 201 is a first holding surface 203 for holding the first developing roller 110A at the first retracted position so as to extend in parallel to the fore-and-aft direction.

Figure 6A:
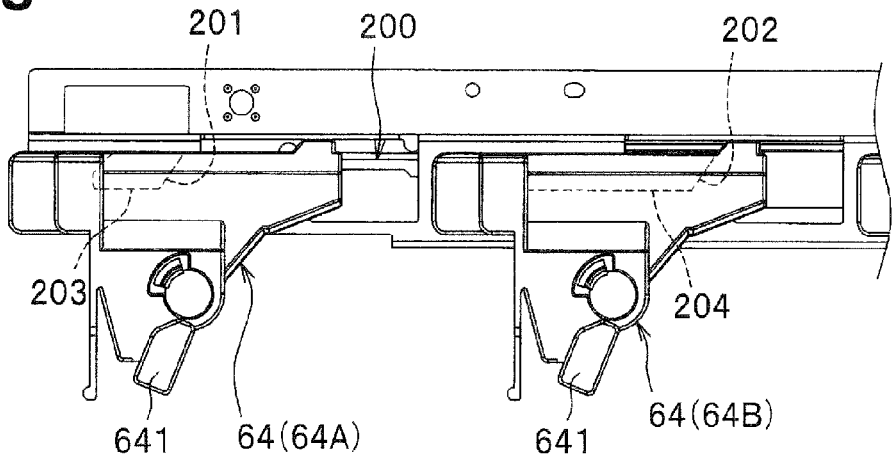
FIG. 6A is a drawing showing a relationship between a cam surface and a retraction lever in a color mode.
Figure 6B:
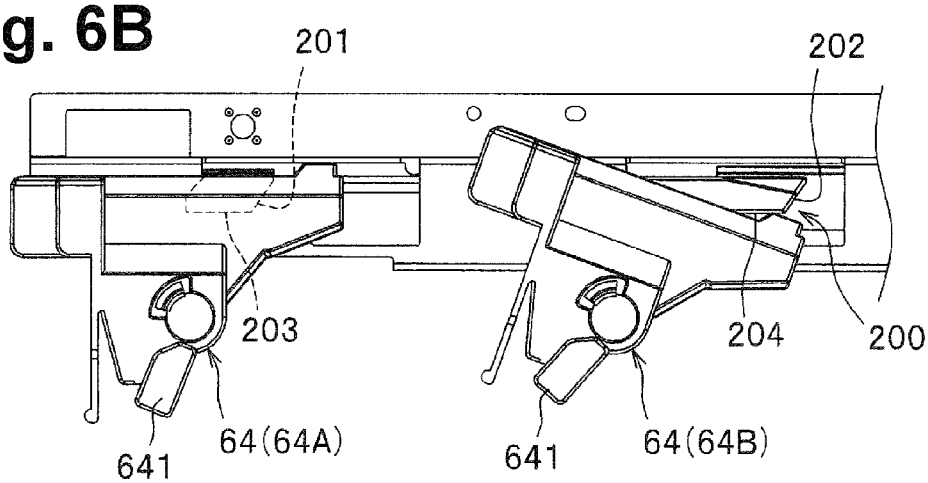
FIG. 6B is a drawing showing the relationship between the cam surface and the retraction lever in a monochrome mode.
Figure 6C:
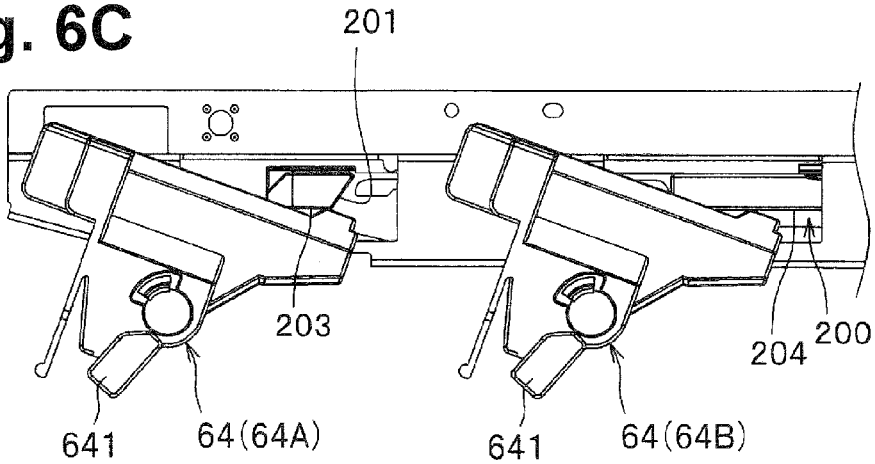
FIG. 6C is a drawing showing the relationship between the cam surface and the retraction lever in a completely retracted mode.

Accordingly, as shown in FIGS. 6A to 6C, when the contact and retract cam 200 is moved backward, the first cam surface 201 comes into abutment with a first retraction lever 64A corresponding to the first developing roller 110A and pushes the first retraction lever 64A downward clockwise in the drawing. Then, when the first retraction lever 64A is pushed to the first holding surface 203, the first holding surface 203 receives the first retraction lever 64A (an urging force of the first pressing member 63A), so that the first developing roller 110A is held at the first retracted position.

In contrast, when the contact and retract cam 200 is moved forward from the position shown in FIG. 6C, the first retraction lever 64A urged by the first pressing member 63A moves so as to slide on the first holding surface 203 and the first cam surface 201 (the surface which receives the urging force from the first retraction lever 64A is switched from the first holding surface 203 to the first cam surface 201), so that the position is returned to a position shown in FIG. 6A and the first developing roller 110A is moved to the first contact position.

The second cam surfaces 202 each are a cam surface configured to move the second developing roller 110B for color from the second contact position to the second retracted position, and are formed obliquely with respect to the fore-and-aft direction. Formed on the front side of each of the second cam surfaces 202 is second holding surface 204 for holding the second developing roller 110B at the second retracted position so as to extend in parallel to the fore-and-aft direction.

Accordingly, the second cam surface 202 and the second holding surface 204 demonstrate the same actions as the first cam surface 201 and the first holding surface 203 described above. In other words, as shown in FIGS. 6A to 6C, when the contact and retract cam 200 is moved backward, a second refraction lever 64B corresponding to the second developing roller 110B rotates clockwise in the drawing, and the second developing roller 110B is held at the second retracted position. When the contact and retract cam 200 is moved forward, the second retraction lever 64B rotates counterclockwise in the drawing so that the second developing roller 110B is moved to the second contact position.

Figure 5:
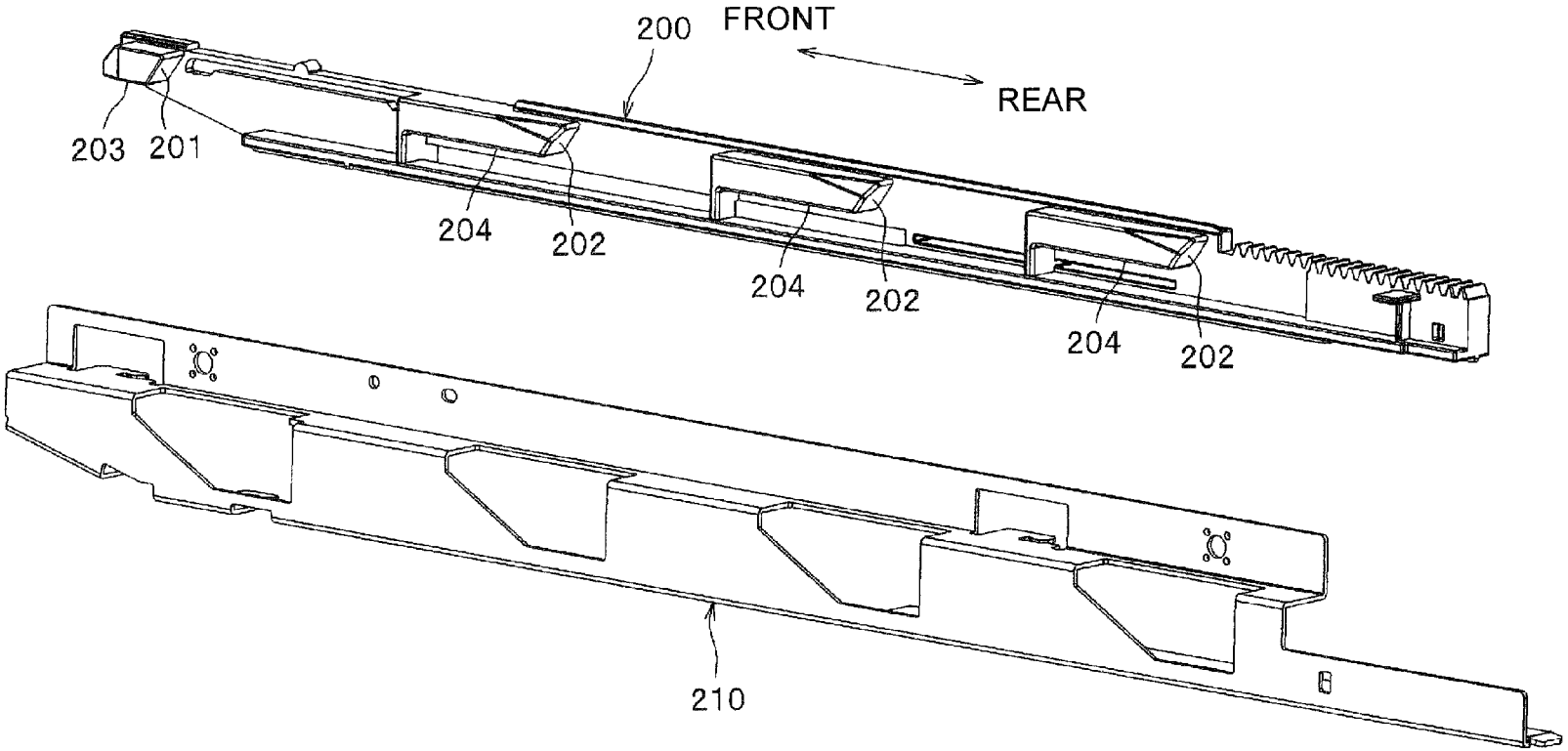
FIG. 5 is an exploded perspective view showing the contact and retract cam in FIG. 4 in an exploded state.

As shown in FIG. 5, the distances between an adjacent pair of the second cam surfaces 202 are the same, and the distance between adjacent first cam surface 201 and second cam surface 202 is set to be longer than the distance between the pair of the second cam surfaces 202. In other words, the plurality of the retraction levers 64 are arranged at regular pitches, and hence the position of the first cam surface 201 with respect to the first retraction lever 64A and the positions of the second cam surfaces 202 with respect to the second refraction levers 64B are set to be different.

In other words, since the respective retraction levers 64 are arranged at the same positions with respect to the respective developing rollers 110, the position of the first cam surface 201 with respect to the first developing roller 110A and the positions of the second cam surfaces 202 with respect to the second developing rollers 110B are set to be different. Accordingly, as shown in FIGS. 6A to 6C, the timing of start of movement of the first retraction lever 64A and the second retraction lever 64B can be changed, so that the mode of the contact and retract state of the developing roller 110 can be switched into three modes.

Figure 7:
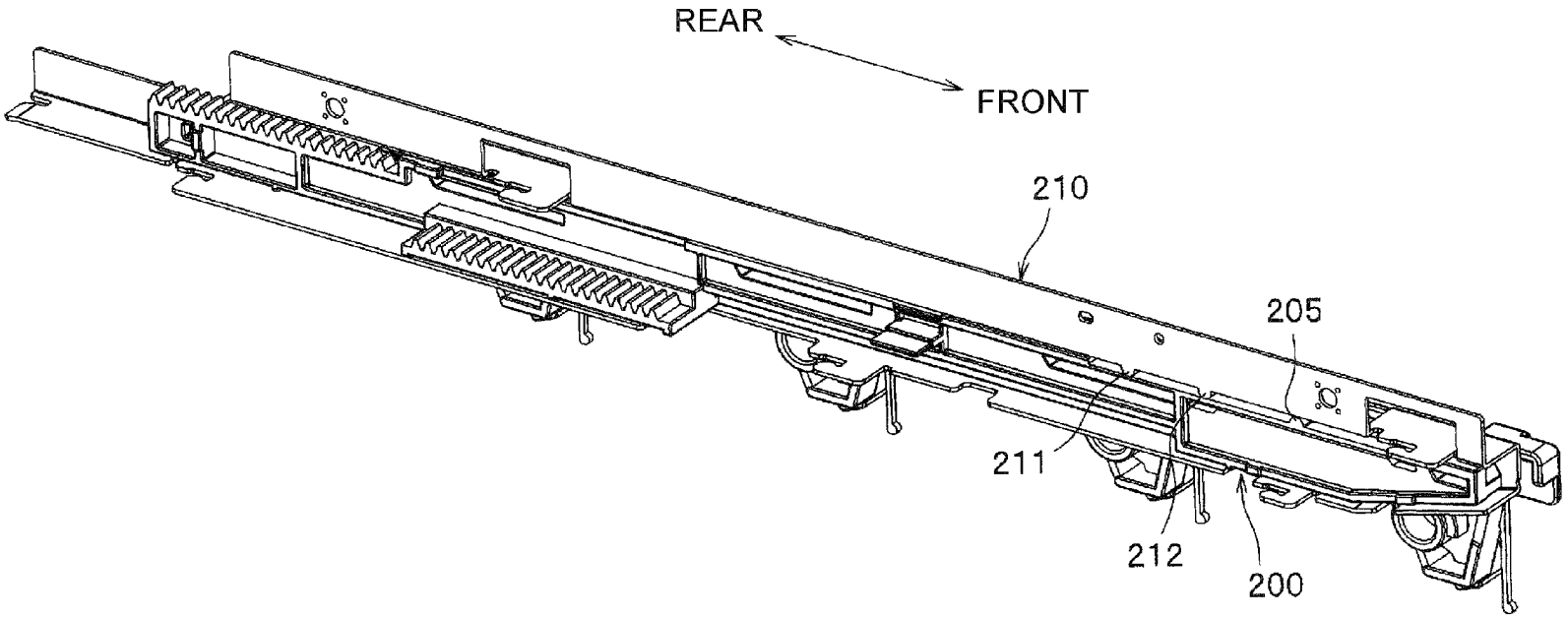
FIG. 7 is a perspective view of the contact and retract cam viewed from outside in the lateral direction.
Figure 8:
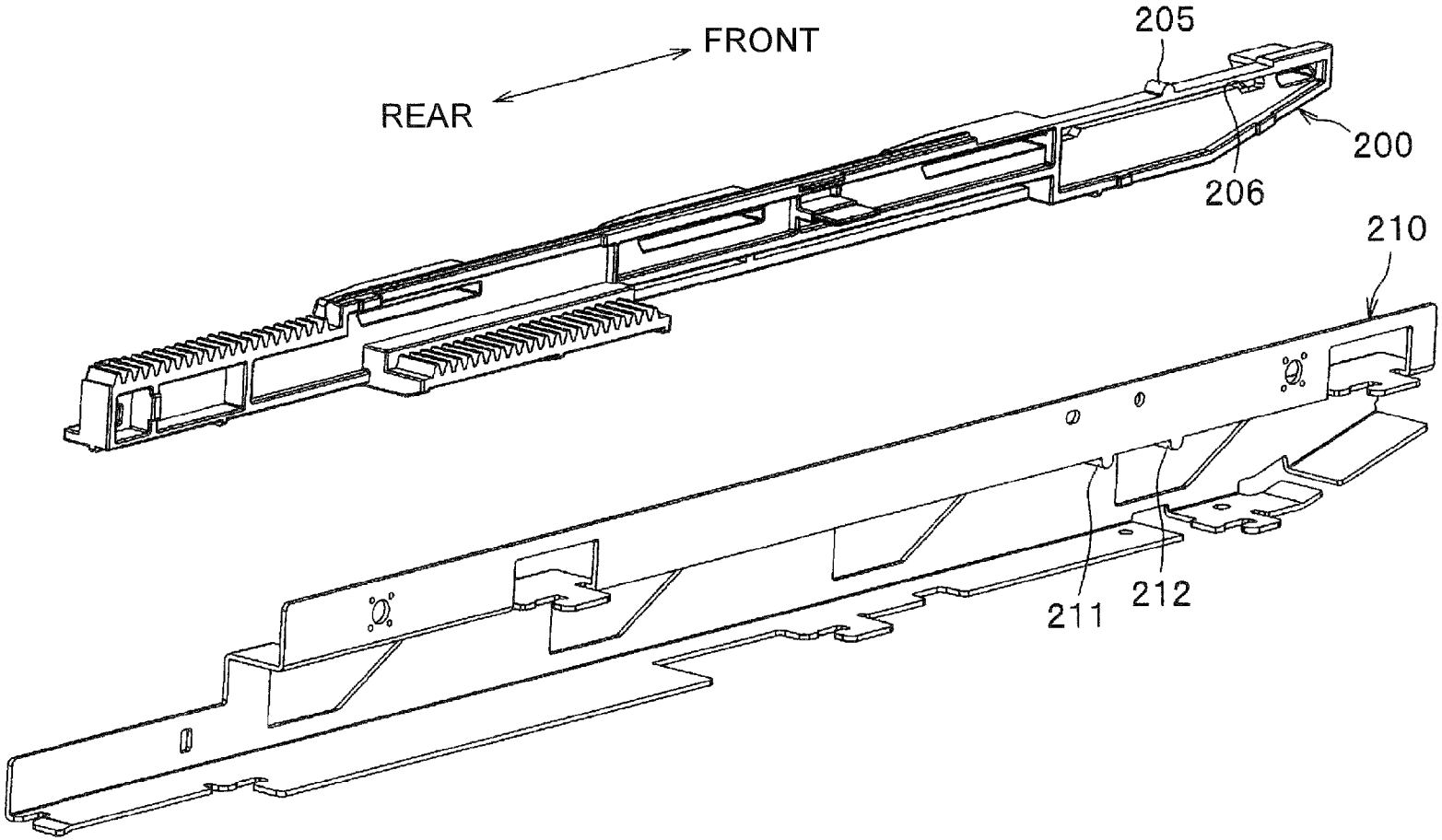
FIG. 8 is an exploded perspective view showing the contact and retract cam in FIG. 7 in an exploded state.

More specifically, the contact and retract state of the developing rollers 110 can be switched to a color mode in which all the developing rollers 110 come into contact with the respective photosensitive drums 61 as shown in FIG. 6A, a monochrome mode in which only the first developing roller 110A for monochrome comes into contact with the photosensitive drum 61 as shown in FIG. 6B, and a totally retracted mode in which all the developing rollers 110 are retracted from the respective photosensitive drums 61 as shown in FIG. 6C. Incidentally, when the DC motor 400 having a weak holding power is employed as the drive source for driving the contact and retract cam 200 as in this embodiment, the contact and retract cam 200 cannot be stopped at positions corresponding to the respective modes due to an inertia rotation of the DC motor 400 and hence may move to a position corresponding to a different mode. Accordingly, in this embodiment, as shown in FIG. 7 and FIG. 8, a cam-side projection 205 as an example of a second engaging portion is provided on the contact and retract cam 200, and a rear projection 211 and a front projection 212 as examples of a first engaging portion and a third engaging portion are provided on the supporting member 210.

More specifically, the cam-side projection 205 is formed so as to project upward from the front side of an upper surface of the contact and retract cam 200 so as to be engageable with respect to the rear projection 211 and the front projection 212 in the fore-and-aft direction. The cam-side projection 205 is formed integrally with the contact and retract cam 200 formed of a resin, and a hole 206 is formed on the side opposite from the upper surface (the surface coming into contact with the rear projection 211). Accordingly, the cam-side projection 205 is capable of being resiliently deformed (displaced)

upward and downward and climbing over (an example of passing over) the rear projection 211 or the front projection 212 when the contact and retract cam 200 is moved forward and backward by a force not smaller than the drive force of the DC motor 400, and is configured not to be capable of climbing over the rear projection 211 or the front projection 212 even when the contact and retract cam 200 is moved forward and backward by a force smaller than the drive force of the DC motor 400 (for example, an inertia force remaining after the control device 450 turns the drive of the DC motor 400 OFF).

The rear projection 211 and the front projection 212 are arranged at a distant in the fore-and-aft direction, and are formed so as to project downward from the front upper portion of the supporting member 210. Arrangement of the rear projection 211, the cam-side projection 205, and the front projection 212 will be described in detail below.

Figure 9A:
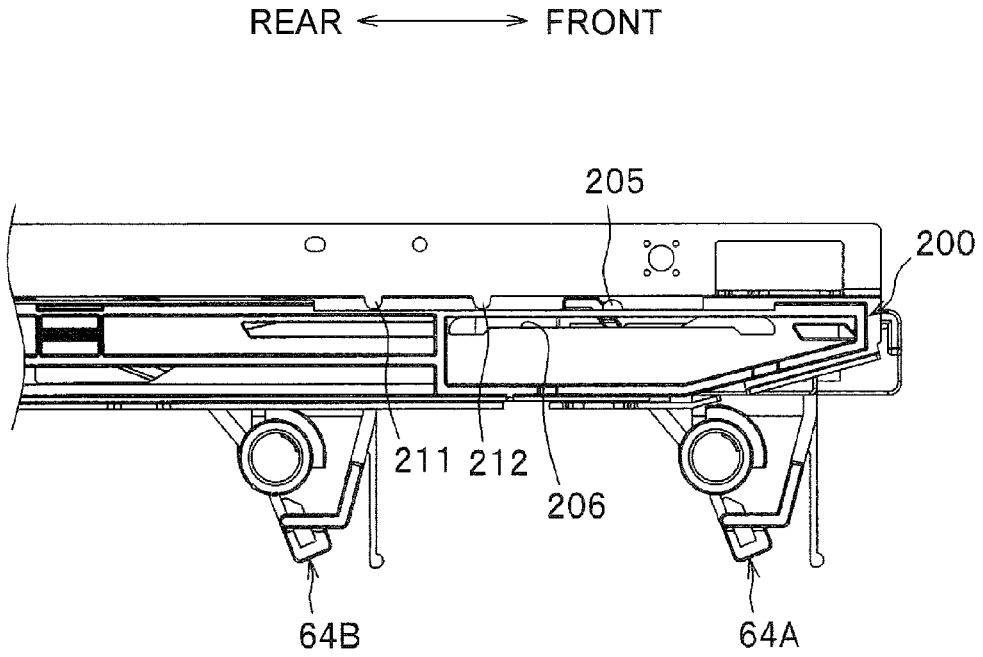
FIGS. 9A and 9B are drawings showing positional relationships of respective projections in the color mode.
Figure 9B:
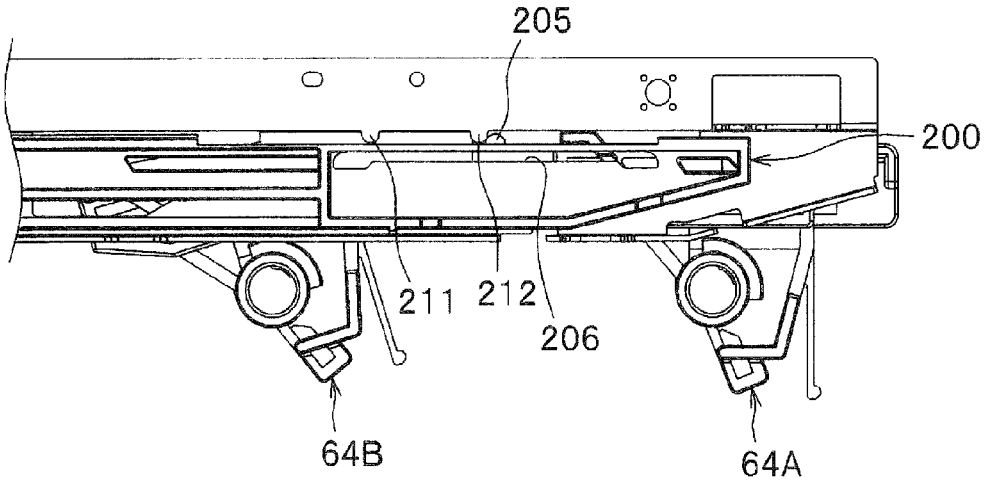
Figure 10A:
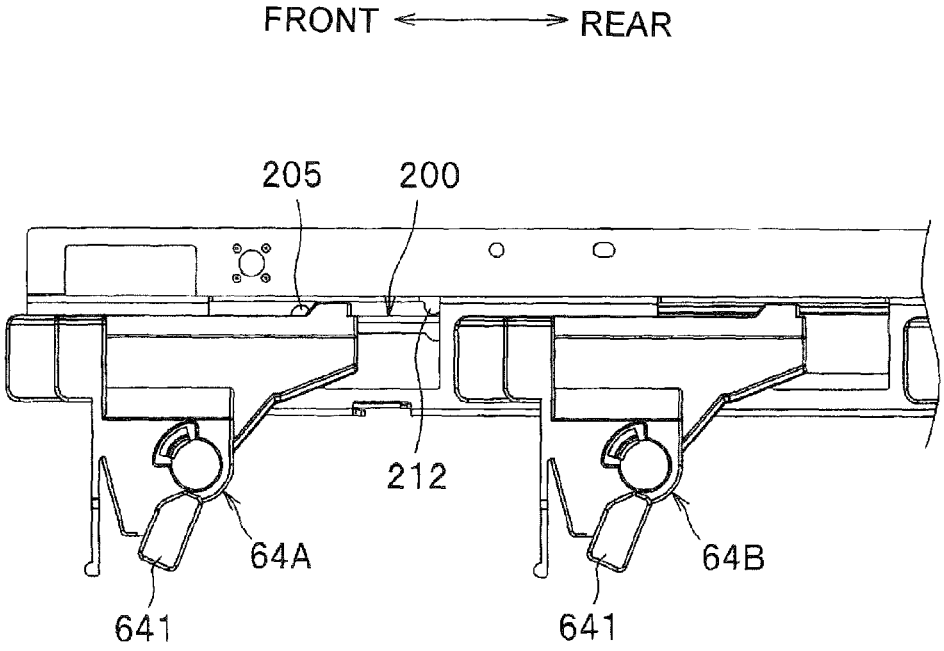
FIGS. 10A and 10B are drawings showing the relationship between the cam surface and the retraction lever in the color mode.
Figure 10B:
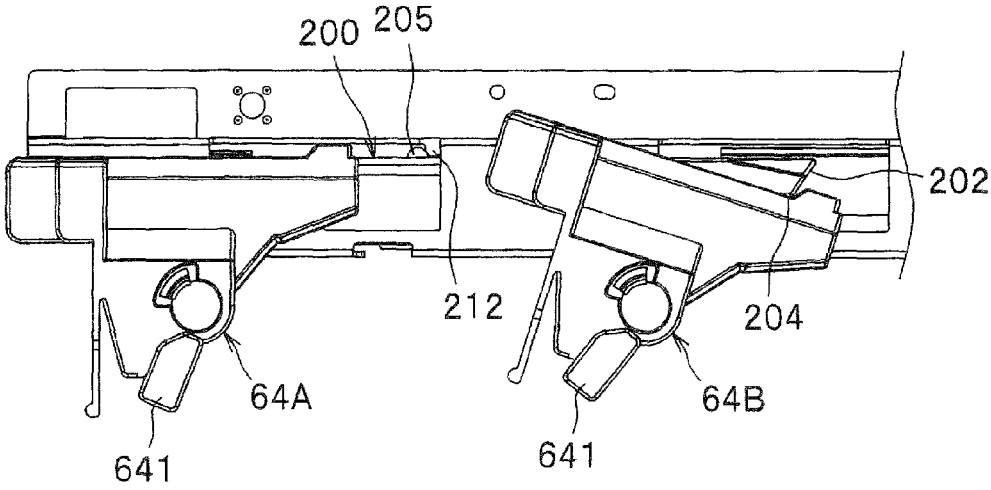

As shown in FIGS. 9A and 9B, in the color mode, the cam-side projection 205 is located on the side opposite from the rear projection 211 across the front projection 212. In other words, as shown in FIG. 10A and FIG. 10B in this sequence, when the contact and retract cam 200 is moved backward, the front projection 212 and the cam-side projection 205 engage with respect to each other before the surface where the second retraction lever 64B comes into sliding contact (the surface that receives an urging force from the second pressing member 63B) is switched from the second cam surfaces 202 to the second holding surfaces 204. Accordingly, unless otherwise the drive force from the DC motor 400 is applied to the contact and retract cam 200, the backward movement of the contact and retract cam 200 is restricted by the front projection 212, whereby the contact and retract cam 200 can be held at the position corresponding to the color mode, and the three second developing rollers 110B for colors can be prevented from moving to the second retracted positions.

Figure 11A:
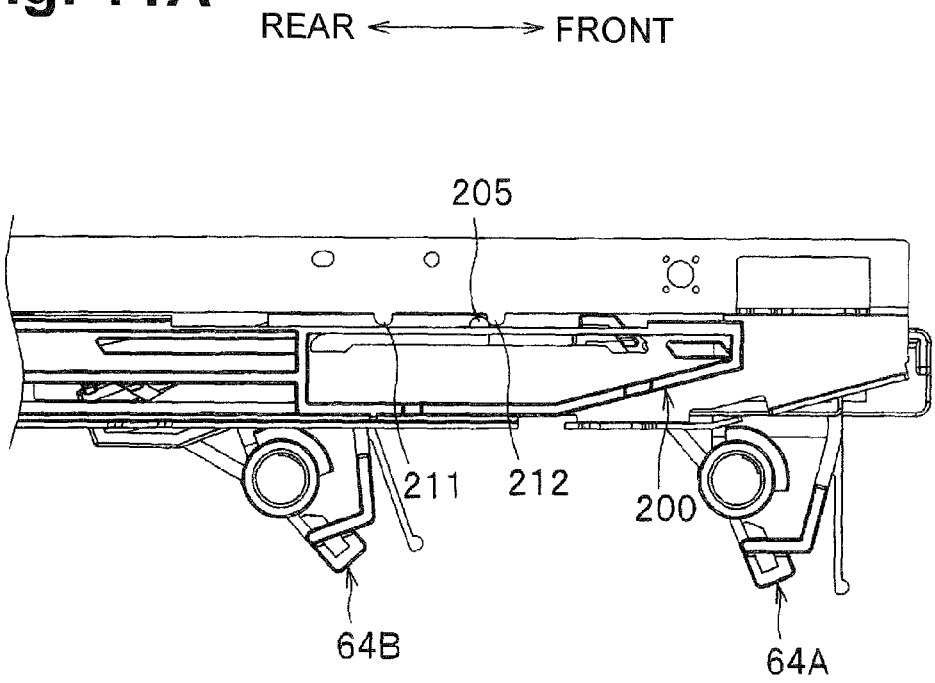
FIGS. 11A and 11B are drawings showing the positional relationships of the respective projections in the monochrome mode.
Figure 12A:
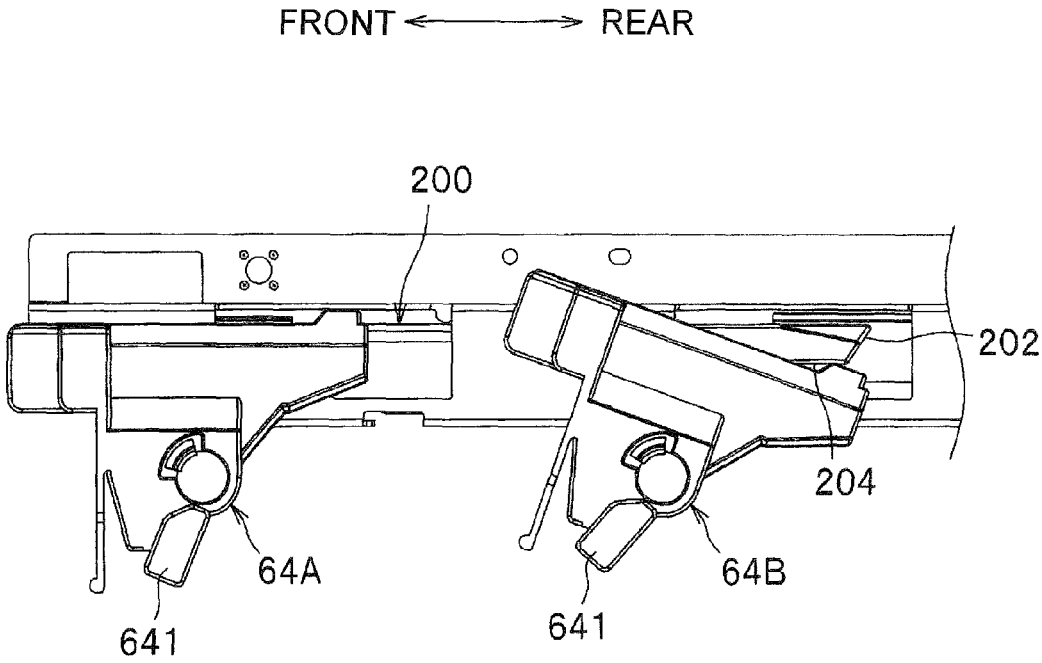
FIGS. 12A and 12B are drawings showing the relationship between the cam surface and the refraction lever in the monochrome mode.

In the color mode, when the drive force from the DC motor 400 is applied to the contact and retract cam 200, and the contact and retract cam 200 is moved backward, the cam-side projection 205 climbs over the front projection 212 as shown in FIG. 11A, and the surface with which the second retraction lever 64B comes into sliding contact is switched from the second cam surfaces 202 to the second holding surfaces 204 as shown in FIG. 12A. Accordingly, the three second developing rollers 110B for colors are moved to the second retracted positions, and the mode is switched to the monochrome mode.

Figure 11B:
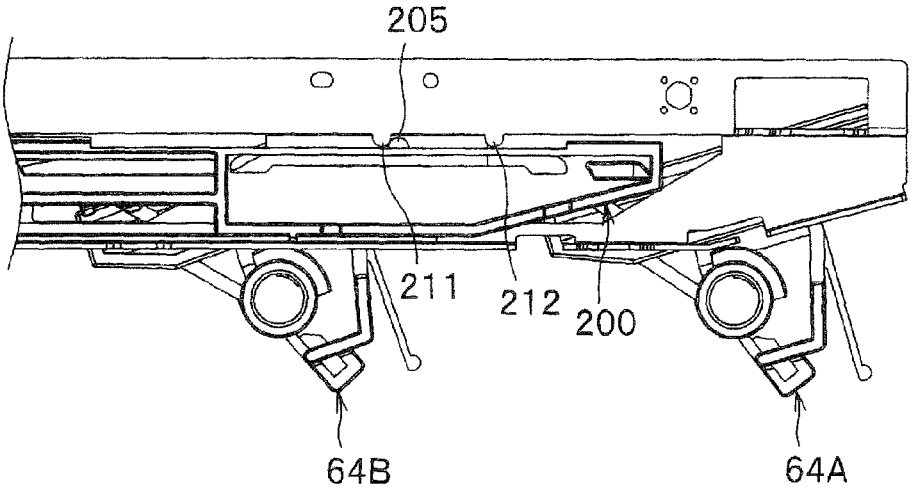

As shown in FIGS. 11A and 11B, in the monochrome mode, the cam-side projection 205 is located between the rear projection 211 and the front projection 212. In other words, as shown in FIG. 12A and FIG. 12B in this sequence, when the contact and retract cam 200 is moved backward, the rear projection 211 and the cam-side projection 205 engage with respect to each other before the surface with which the first retraction lever 64A comes into sliding contact (the surface that receives an urging force from the first pressing member 63A) is switched from the first cam surface 201 to the first holding surface 203 (see FIGS. 11B and 14B).

Figure 12B:
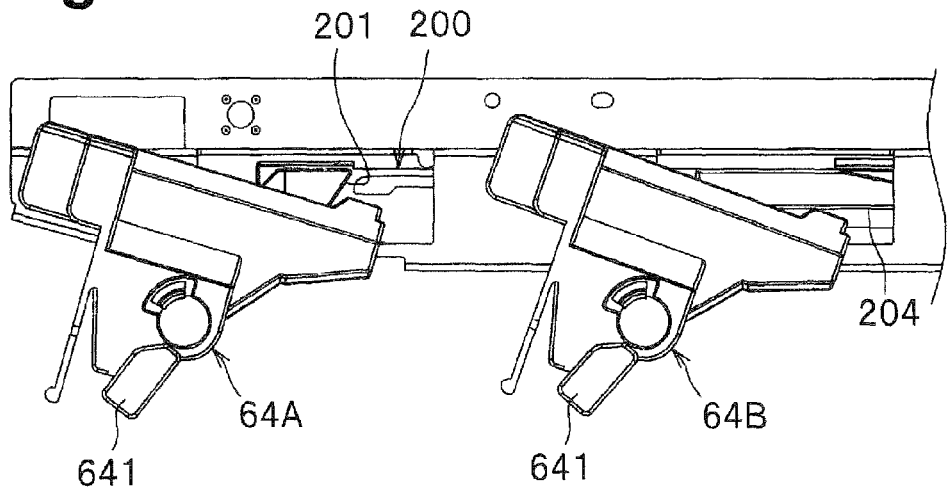

Also, as shown in FIG. 12B and FIG. 12A in this sequence, when the contact and retract cam 200 is moved forward, the front projection 212 and the cam-side projection 205 engage with respect to each other before the surface with which the second retraction lever 64B comes into sliding contact is switched from the second holding surface 204 to the second cam surfaces 202 (see FIG. 11A). Accordingly, unless otherwise the drive force from the DC motor 400 is applied to the contact and retract cam 200, the movement of the contact and retract cam 200 is restricted by the rear projection 211 or the front projection 212, whereby the contact and retract cam 200 can be held at the position corresponding to the monochrome mode.

Figure 13A:
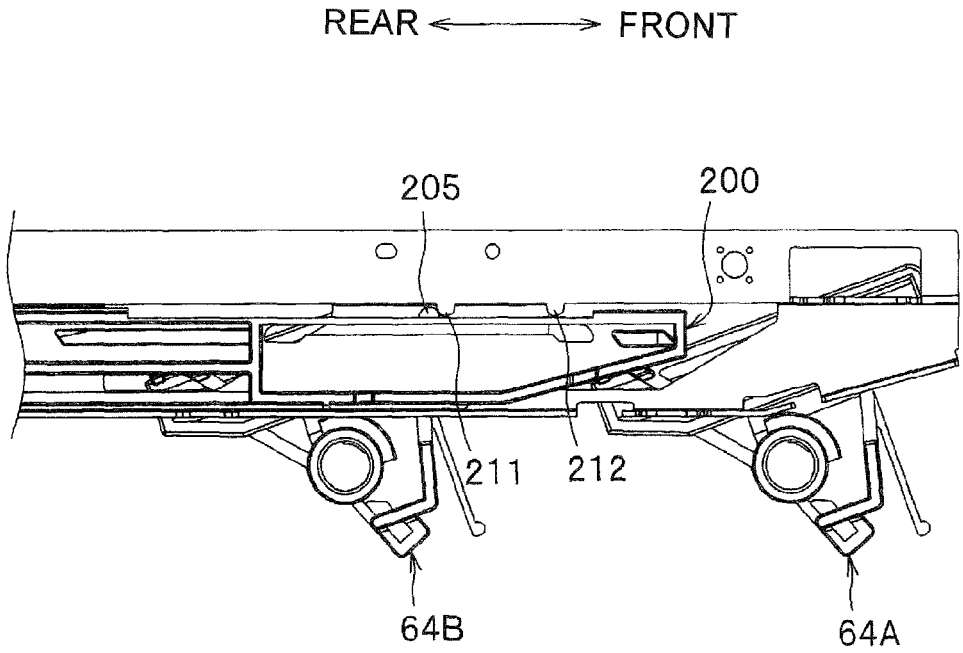
FIGS. 13A and 13B are drawings showing the positional relationships of the respective projections in the completely retracted mode.
Figure 14A:
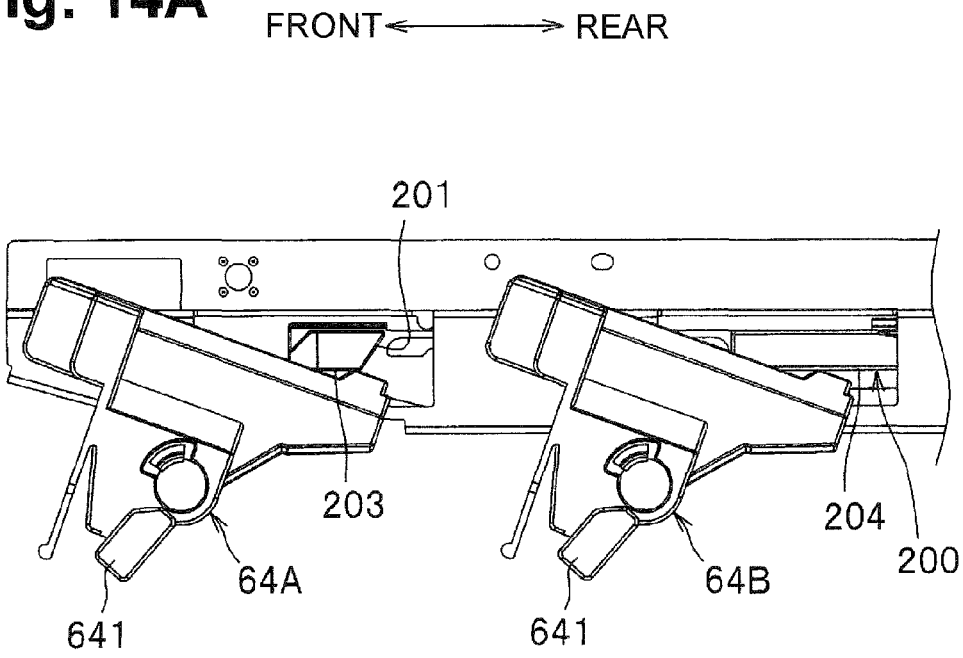
FIGS. 14A and 14B are drawings showing the relationship between the cam surface and the retraction lever in the completely retracted mode.

In the monochrome mode, when the drive force from the DC motor 400 is applied to the contact and retract cam 200, and the contact and retract cam 200 is moved backward, the cam-side projection 205 climbs over the rear projection 211 as shown in FIG. 13A, and the surface with which first retraction lever 64A comes into sliding contact is switched from the first cam surface 201 to the first holding surface 203 as shown in FIG. 14A. Accordingly, the first developing roller 110A for monochrome is moved to the first retracted position, and the mode is switched to the totally retracted mode.

Figure 13B:
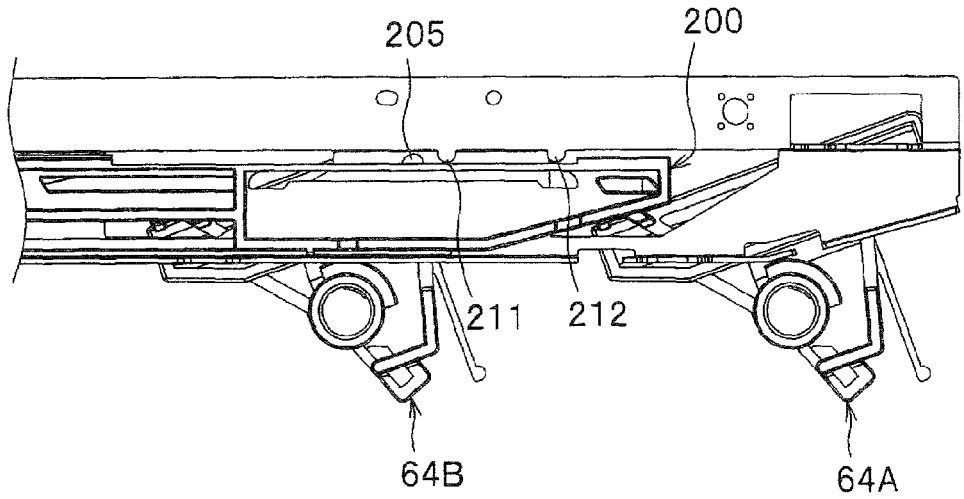
Figure 14B:
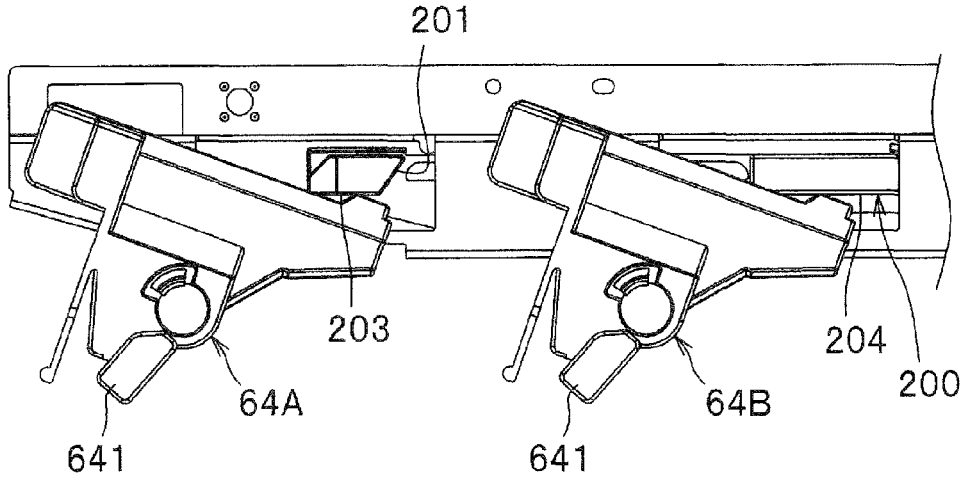

As shown in FIGS. 13A and 13B, in the totally retracted mode, the cam-side projection 205 is located on the side opposite from the front projection 212 across the rear projection 211. In other words, as shown in FIG. 14B and FIG. 14A in this sequence, when the contact and retract cam 200 is moved forward, the rear projection 211 and the cam-side projection 205 engage with respect to each other before the surface with which the first retraction lever 64A comes into sliding contact (the surface receiving the urging force from the first pressing member 63A) is switched from the first holding surface 203 to the first cam surfaces 201 (see FIG. 13A). Accordingly, unless otherwise the drive force from the DC motor 400 is applied to the contact and retract cam 200, the forward movement of the contact and retract cam 200 is restricted by the rear projection 211, whereby the contact and retract cam 200 can be held at the position corresponding to the totally retracted mode.

Then the contact and retract cam 200 is controlled by the control device 450 shown in FIG. 1. The control device 450 is provided with a CPU, a RAM, a ROM, and an I/O circuit, and executes control by performing respective arithmetic processes on the basis of programs or data stored in the ROM.

More specifically, the apparatus body 10 is provided with a sensor 460 configured to sense an initial position of the contact and retract cam 200 (the position shown in FIG. 6A, for example), and the control device 450 also executes control such as determining whether or not the contact and retract cam 200 has reached the initial position on the basis of the signal from the sensor 460 and, if it has not reached, also controls the DC motor 400 to return the contact and retract cam 200 to the initial position. Accordingly, when the contact and retract cam 200 is shifted from the initial position when an attempt is made to return the contact and retract cam 200 to the initial position, the control device 450 calculates the shift amount on the basis of a signal from the sensor 460, and fine adjusts the position of the contact and retract cam 200 by rotating the DC motor 400 in the normal direction or the reverse direction on the basis of the shift amount, so that the contact and retract cam 200 can be returned to the initial position reliably.

In the configuration, in this embodiment, the following effects are achieved.

Since the movement of the contact and retract cam 200 is restricted by the engagement of the cam-side projection 205 and the rear projection 211 or the front projection 212, the force smaller than the drive force from the DC motor 400 (the force of the inertia rotation of the DC motor 400, for example) is applied to the contact and retract cam 200, the contact and retract cam 200 can be maintained at a desired position.

Since the cam-side projection 205 is engaged with the two projections 211 and 212, the contact and retract cam 200 can be held at the positions corresponding to the three modes.

By forming the cam-side projection 205 integrally with the contact and retract cam 200 formed of the resin, the cam-side projection 205 is configured to be resiliently deformable. Therefore, for example, in comparison with a mode where the cam-side projection 205 is formed as a separate member from the contact and retract cam 200 and is provided on the contact and retract cam 200 via a resilient member, the cam-side projection 205 can be displaced with a simple configuration.

Since the hole 206 is formed on the contact and retract cam 200 on the side opposite from an upper surface of the cam-side projection 205, the resilient force of the cam-side projection 205 can be adjusted easily by the size of the hole 206, so that restriction and release of the movement of the contact and retract cam 200 can be performed more reliably.

Since the DC motor 400 is employed as the drive source for driving the contact and retract cam 200, the cost can be reduced in comparison with the stepping motor as in the related art. When the DC motor 400 is used as the drive source of the contact and retract cam 200, the effect of the invention (the effects of restricting the movement of the contact and retract cam 200) can be demonstrated further obviously.

Since the electromagnetic clutch 410 is provided on the transmitting mechanism for transmitting the drive force from the DC motor 400 to the contact and retract cam 200, the DC motor 400 can be shared with other members (such as the photosensitive drums 61).

Since the control device 450 executes the control to return the contact and retract cam 200 to the initial position on the basis of the signal from the sensor 460, even when the contact and retract cam 200 is shifted from the initial position, the contact and retract cam 200 can be returned reliably back to the initial position.

The invention is not limited to the embodiment described above, and may be used in various modes as exemplified below. In the following description, members having substantially the same structure as those in the embodiment described above, the same reference numerals are allocated and the description is omitted.

In the embodiment described above, both of the forward movement and the backward movement of the contact and retract cam 200 are restricted by the engagement with the respective projections 205, 211, and 212. However, the invention is not limited thereto, and any means is applicable as long as at least the forward movement of the contact and retract cam 200 is restricted by the engagement of the respective projection 205, 211 and 212. In other words, the cam-side projection 205 and the rear projection 211 only have to engage with each other before the surface that receives the urging force from the first pressing member 63A is switched from the first holding surface 203 to the first cam surface 201, and the invention may be configured in such a manner that the engagement is achieved after having switched when the surface that receives the urging force from the first cam surface 201 to the first holding surface 203. Also, the cam-side projection 205 and the front projection 212 only have to be engaged with each other before the surface that receives the urging force is switched from the second holding surfaces 204 to the second cam surfaces 202.

Figure 15A:
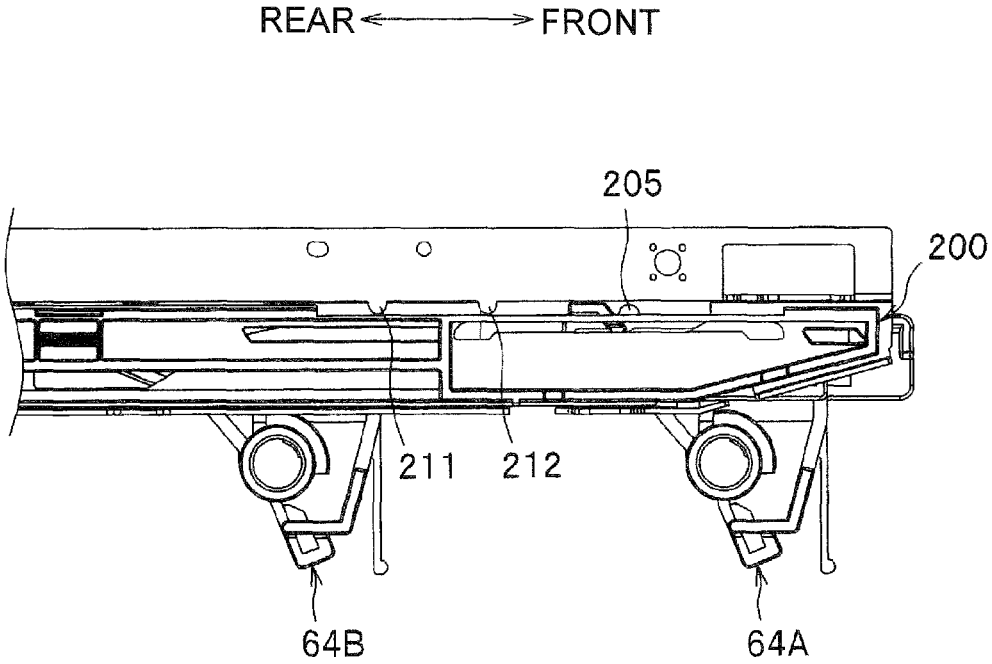
FIGS. 15A and 15B are drawings according to another embodiment showing the positional relationships of the respective projections in the color mode.
Figure 15B:
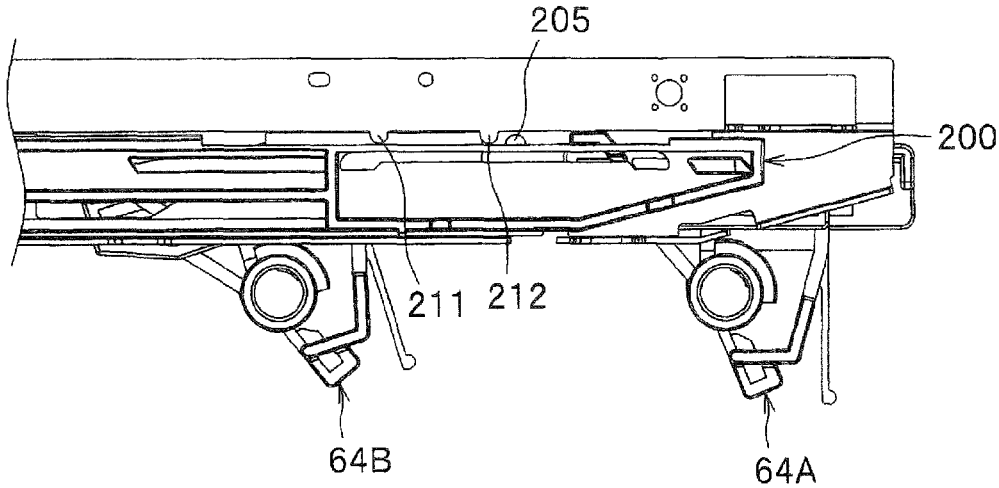
Figure 16A:
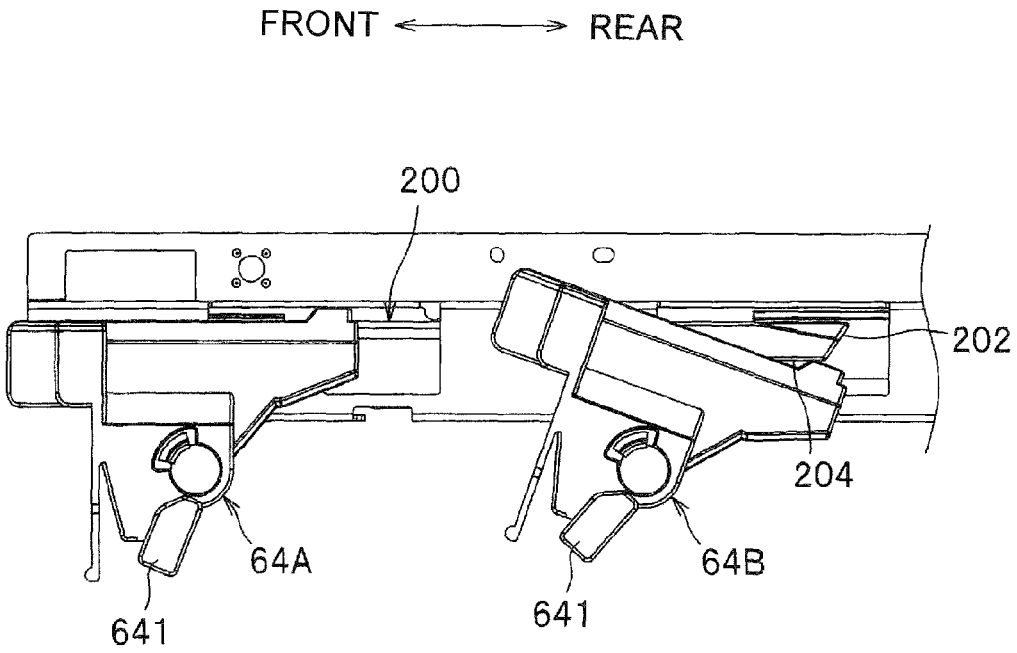
FIGS. 16A and 16B are drawings showing the relationship between the cam surface and the refraction lever at positions corresponding to FIGS. 15A and 15B.
Figure 16B:
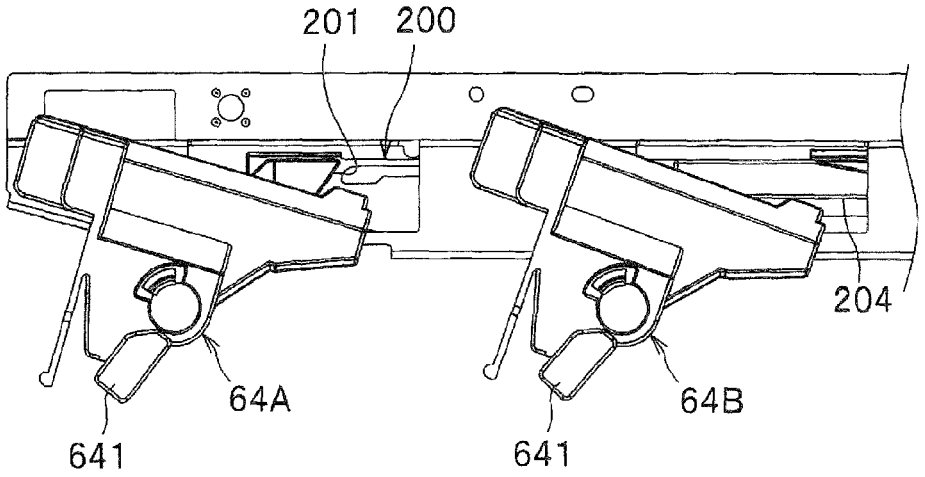

More specifically, as shown in FIGS. 15A and 15B, when the contact and retract cam 200 is moved backward so as to be translated from the color mode to the monochrome mode, the movement of the contact and retract cam 200 may be restricted by the engagement of the second cam surfaces 202 and the second retraction lever 64B as shown in FIGS. 16A and 16B, before the cam-side projection 205 and the front projection 212 engage.

Figure 17A:
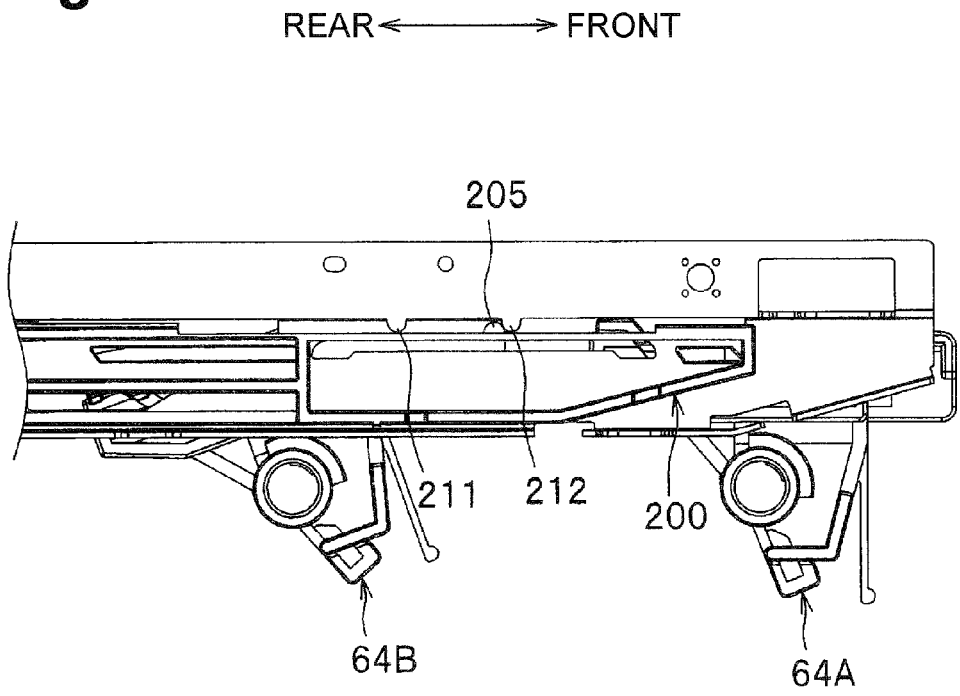
FIGS. 17A and 17B are drawings showing the positional relationships of the respective projections when the mode in FIGS. 15A and 15B is changed to the monochrome mode.
Figure 17B:
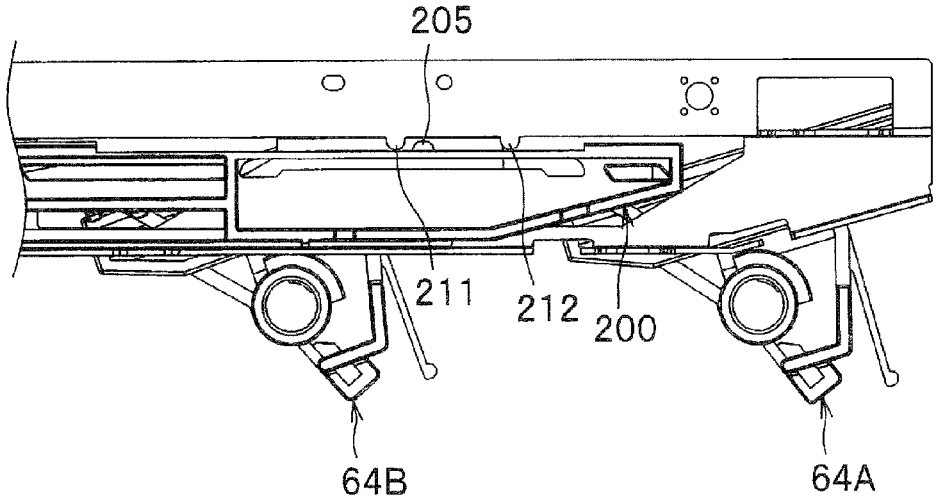
Figure 18A:
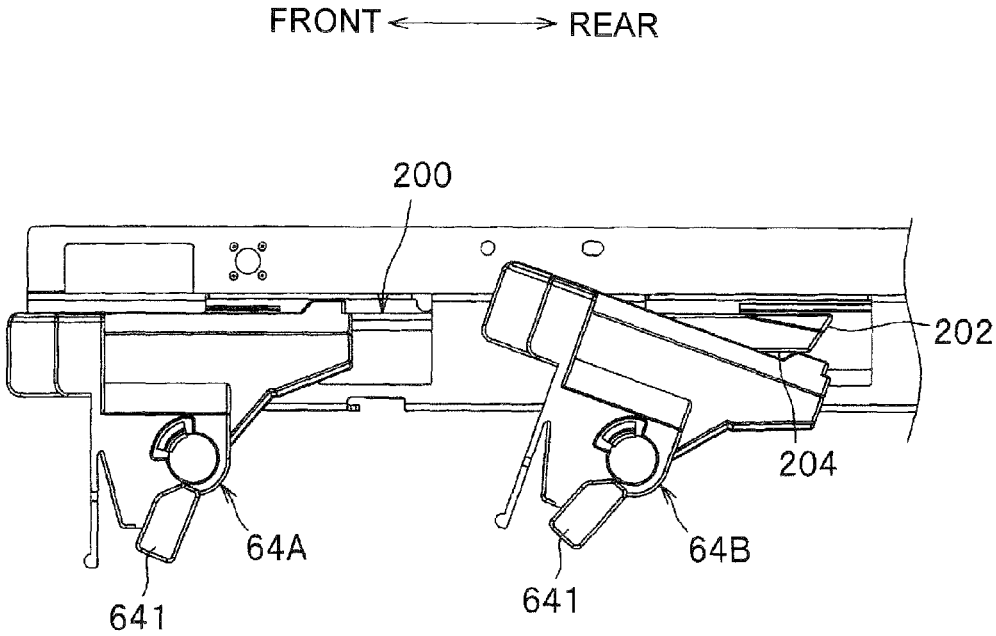
FIGS. 18A and 18B are drawings showing the relationship between the cam surface and the refraction lever at positions corresponding to FIGS. 17A and 17B.
Figure 18B:
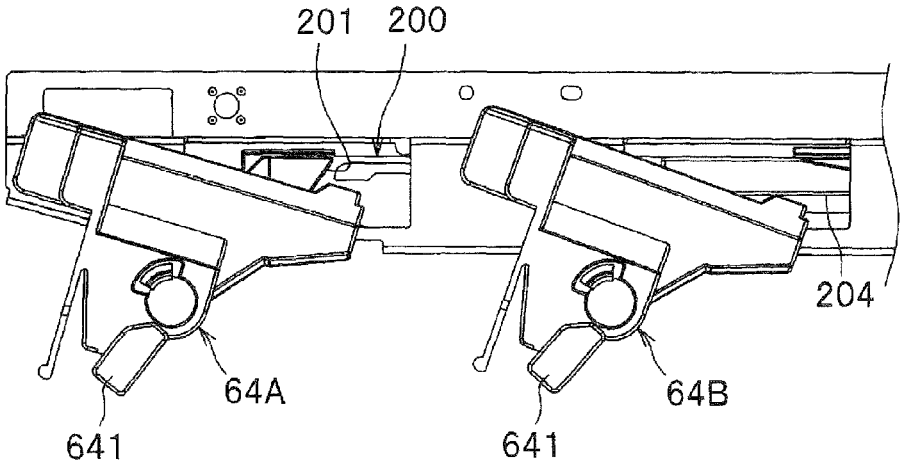

As shown in FIGS. 17A and 17B, when the contact and retract cam 200 is moved backward so as to be translated from the monochrome mode to the totally retracted mode, the movement of the contact and retract cam 200 may be restricted by the engagement of the first cam surface 201 and the first retraction lever 64A as shown in FIGS. 18A and 18B, before the cam-side projection 205 and the rear projection 211 engage. Also, the forward movement of the contact and retract cam 200 is, in the same manner as the embodiment described above, restricted by the engagement of the respective projections 205, 211, and 212, the description will be omitted. In this structure as well, the contact and retract cam 200 can be maintained at the predetermined position.

In the embodiment described above, the front projection 212 as an example of the third engaging portion is provided on the supporting member 210. However, the invention is not limited thereto, and the third engaging portion may be provided on the contact and retract cam 200. In other words, in contrast to the embodiment, a configuration in which two engaging portions are provided on the contact and retract cam 200 and one engaging portion is provided on the supporting member 210 is also applicable. In this case as well, in the same manner as the embodiment described above, the contact and retract cam 200 can be held at the positions corresponding to the three modes.

In the embodiment described above, the supporting member 210 configured to support the contact and retract cam 200 is exemplified as the adjacent member. However, the invention is not limited thereto, and may be a member which does not support the contact and retract cam 200.

In the embodiment described above, the DC motor 400 is exemplified as the drive source. However, the invention is not limited thereto, and may be other motors having a weak holding force.

In the embodiment described above, the rotatable first pressing member 63A and rotatable second pressing members 63B urged by the torsion springs 65 have been exemplified as the urging means, the invention is not limited thereto and, for example, a coil spring is also applicable.

In the embodiment described above, the projections 205, 211, and 212 are employed as the respective engaging portions. However, the invention is not limited thereto and, for example, projections and depressions may be employed.

In the embodiment described above, the projection 205 is formed integrally with the contact and retract cam 200, a resilient member such as a leaf spring may be provided on the contact and retract cam 200.

In the embodiment described above, the invention is applied to the color printer 1. However, the invention is not limited thereto, and may be applied to other image forming apparatuses such as monochrome printers, copying machines or multifunctional peripherals.

What is claimed is:

1. An image forming apparatus comprising:

a drive source;

a first photosensitive member on which an electrostatic latent image is to be formed;

a first developing roller configured to supply developer to the first photosensitive member;

a first urging member configured to urge the first developing roller toward the first photosensitive member;

a translation cam configured to be moved in a predetermined direction upon receipt of a drive force from the drive source and to move the first developing roller between a first contact position contacting the first photosensitive member and a first retracted position retracted from the first photosensitive member; and an adjacent member which includes a first engaging portion and which is adjacent to the translation cam, wherein the translation cam has a first cam surface configured to move the first developing roller from the first contact position to the first retracted position and a first holding surface configured to hold the first developing roller at the first retracted position, and the translation cam includes a second engaging portion engageable, in the predetermined direction, with the first engaging portion, and wherein the first engaging portion and the second engaging portion are positioned such that the first engaging portion and the second engaging portion engage each other before a surface to receive an urging force from the first urging member is switched from the first holding surface to the first cam surface, and are configured such that one of the first engaging portion and the second engaging portion does not climb over the other one of the first engaging portion and the second engaging portion when a force smaller than the drive force from the drive source is applied to the translation cam, and the one of the first engaging portion and the second engaging portion climbs over the other one of the first engaging portion and the second engaging portion when a force equal to or larger than the drive force from the drive source is applied to the translation cam.

2. The image forming apparatus according to claim 1, further comprising:

a second photosensitive member on which an electrostatic latent image is to be formed;

a second developing roller configured to supply a developer to the second photosensitive member and movable between a second contact position contacting the second photosensitive member and a second retracted position retracted from the second photosensitive member; and a second urging member configured to urge the second developing roller toward the second photosensitive member, wherein:

the translation cam has a second cam surface configured to move the second developing roller from the second contact position to the second retracted position and has a second holding surface configured to hold the second developing roller at the second retracted position, the adjacent member includes a third engaging portion configured to engage the second engaging portion in the predetermined direction, and the second engaging portion and the third engaging portion are positioned such that the third engaging portion and the second engaging portion engage each other before a surface to receive an urging force from the second urging member is switched from the second holding surface to the second cam surface, and are configured to be displaceable such that one of the second engaging portion and the third engaging portion does not climb over the other one of the second engaging portion and the third engaging portion when the force smaller than the drive force from the drive source is applied to the translation cam, and the one of the second engaging portion and the third engaging portion climbs over the other one of the second engaging portion and the third engaging portion when the force equal to or larger than the drive force from the drive source is applied to the translation cam.

3. The image forming apparatus according to claim 1, further comprising:

a second photosensitive member on which an electrostatic latent image is to be formed;

a second developing roller configured to supply a developer to the second photosensitive member and movable between a second contact position contacting the second photosensitive member and a second retracted position retracted from the second photosensitive member; and a second urging member configured to urge the second developing roller toward the second photosensitive member, wherein:

the translation cam has a second cam surface configured to move the second developing roller from the second contact position to the second retracted position and has a second holding surface configured to hold the second developing roller at the second retracted position, the translation cam includes a third engaging portion configured to engage the first engaging portion in the predetermined direction, and the first engaging portion and the third engaging portion are positioned such that the first engaging portion and the third engaging portion engage each other before the surface to receive the urging force from the second urging member is switched from the second holding surface to the second cam surface, and are configured to be displaceable such that one of the first engaging portion and the third engaging portion does not climb over the other one of the first engaging portion and the third engaging portion when the force smaller than the drive force from the drive source is applied to the translation cam, and the one of the first engaging portion and the third engaging portion climbs over the other one of the first engaging portion and the third engaging portion when the force equal to or larger than the drive force from the drive source is applied to the translation cam.

4. The image forming apparatus according to claim 1, wherein the second engaging portion is integrally formed with the translation cam formed of a resin.

5. The image forming apparatus according to claim 4, wherein the translation cam is formed with a hole on a side of the second engaging portion opposite from the surface coming into contact with the first engaging portion.

6. The image forming apparatus according to claim 1, wherein the drive source is a DC motor.

7. The image forming apparatus according to claim 1, further comprising a transmitting mechanism configured to transmit a drive force from the drive source to the translation cam, wherein the transmitting mechanism includes an electromagnetic clutch.

8. The image forming apparatus according to claim 1, further comprising:

a sensor configured to sense an initial position of the translation cam; and a control device configured to determine whether or not the translation cam reaches the initial position based on a signal from the sensor and, if the translation cam does not reach the initial position, to control the drive source to return the translation cam to the initial position.

9. The image forming apparatus according to claim 1, further comprising:

a second photosensitive member on which an electrostatic latent image is to be formed;

a second developing roller configured to supply a developer to the second photosensitive member and movable between a second contact position contacting the second photosensitive member and a second retracted position retracted from the second photosensitive member;

a second urging member configured to urge the second developing roller toward the second photosensitive member; and a third engaging portion configured to engage the second engaging portion in the predetermined direction;

wherein:

the translation cam has a second cam surface configured to move the second developing roller from the second contact position to the second retracted position and has a second holding surface configured to hold the second developing roller at the second retracted position, and the second engaging portion and the third engaging portion are positioned such that the third engaging portion and the second engaging portion engages each other before a surface to receive an urging force from the second urging member is switched from the second holding surface to the second cam surface, and are configured to be displaceable such that one of the second engaging portion and the third engaging portion does not pass over the other one of the second engaging portion and the third engaging portion when the force smaller than the drive force from the drive source is applied to the translation cam, and the one of the second engaging portion and the third engaging portion passes over the other one of the second engaging portion and the third engaging portion when the force equal to or larger than the drive force from the drive source is applied to the translation cam.

10. An image forming apparatus comprising:

a drive source;

a first photosensitive member on which an electrostatic latent image is to be formed;

a first developing roller configured to supply developer to the first photosensitive member;

a first urging member configured to urge the first developing roller toward the first photosensitive member;

a translation cam configured to be moved in a predetermined direction upon receipt of a drive force from the drive source and to move the first developing roller between a first contact position contacting the first photosensitive member and a first retracted position retracted from the first photosensitive member; and a first engaging portion, wherein the translation cam has a first cam surface configured to move the first developing roller from the first contact position to the first retracted position and a first holding surface configured to hold the first developing roller at the first retracted position, and the translation cam includes a second engaging portion engageable, in the predetermined direction, with the first engaging portion, and wherein the first engaging portion and the second engaging portion are positioned such that the first engaging portion and the second engaging portion engage each other before a surface to receive an urging force from the first urging member is switched from the first holding surface to the first cam surface, and are configured such that one of the first engaging portion and the second engaging portion does not pass over the other one of the first engaging portion and the second engaging portion when a force smaller than the drive force from the drive source is applied to the translation cam, and the one of the first engaging portion and the second engaging portion passes over the other one of the first engaging portion and the second engaging portion when a force equal to or larger than the drive force from the drive source is applied to the translation cam.

11. The image forming apparatus according to claim 10, further comprising:

a second photosensitive member on which an electrostatic latent image is to be formed;

a second developing roller configured to supply a developer to the second photosensitive member and movable between a second contact position contacting the second photosensitive member and a second retracted position retracted from the second photosensitive member; and a second urging member configured to urge the second developing roller toward the second photosensitive member, wherein:

the translation cam has a second cam surface configured to move the second developing roller from the second contact position to the second retracted position and has a second holding surface configured to hold the second developing roller at the second retracted position, the translation cam includes a third engaging portion configured to engage the first engaging portion in the predetermined direction, and the first engaging portion and the third engaging portion are positioned such that the first engaging portion and the third engaging portion engage each other before the surface to receive the urging force from the second urging member is switched from the second holding surface to the second cam surface, and are configured to be displaceable such that one of the first engaging portion and the third engaging portion does not pass over the other one of the first engaging portion and the third engaging portion when the force smaller than the drive force from the drive source is applied to the translation cam, and the one of the first engaging portion and the third engaging portion passes over the other one of the first engaging portion and the third engaging portion when the force equal to or larger than the drive force from the drive source is applied to the translation cam.

* * * * *